US005251998A

United States Patent [19]

Laditka

[11] Patent Number: 5,251,998

[45] **Date of Patent: * Oct. 12, 1993**

[54] METHODS AND APPARATUS FOR DISPENSING, MIXING AND APPLYING COATING CONSTITUENTS TO TRAFFIC SURFACES, AND TRAFFIC SURFACES COATED USING SUCH METHODS

[76] Inventor: Alexander Laditka, 4741 Dalebridge #C-10, Warrensville Hts., Ohio 44128

[ * ] Notice: The portion of the term of this patent subsequent to Feb. 4, 2009 has been disclaimed.

[21] Appl. No.: 829,956

[22] Filed: Feb. 3, 1992

Related U.S. Application Data

[63] Continuation-in-part of Ser. No. 586,909, Sep. 24, 1990, Pat. No. 5,085,537, which is a continuation-in-part of Ser. No. 368,084, Jun. 19, 1989, Pat. No. 4,958,955, which is a continuation of Ser. No. 213,449, Jun. 28, 1988, abandoned, which is a continuation of Ser. No. 85,253, Aug. 11, 1987, abandoned, which is a continuation of Ser. No. 892,337, Aug. 1, 1986, abandoned, which is a continuation-in-part of Ser. No. 532,742, Sep. 16, 1983, Pat. No. 4,603,999, which is a continuation-in-part of Ser. No. 408,484, Aug. 16, 1982, Pat. No. 4,477,203.

[51] Int. Cl.[5] ..... E01C 7/06

[52] U.S. Cl. ..... 404/75; 404/111; 404/112

[58] Field of Search ..... 404/75-76, 404/108-113; 222/529, 545; 280/263; 366/345, 346; 299/41, 40; 251/8, 10, 121; 188/15-16

[56] References Cited

U.S. PATENT DOCUMENTS

| | | | |
|---|---|---|---|
| 782,459 | 2/1905 | Morris . | |
| 831,494 | 9/1906 | Alexander . | |
| 1,224,294 | 5/1917 | Franzen . | |
| 1,437,863 | 12/1922 | Raymond . | |
| 1,591,682 | 7/1926 | Ponselle . | |
| 1,914,950 | 6/1933 | Kanen . | |
| 2,033,510 | 3/1936 | Brayley | 16/24 |
| 2,175,511 | 10/1939 | Wahlstrom et al. | 94/44 |
| 2,200,921 | 5/1940 | Granell | 51/177 |
| 2,241,214 | 5/1941 | Milster | 188/152 |
| 2,277,389 | 3/1942 | Conway | 94/45 |
| 2,668,976 | 2/1954 | Beach | 15/230 |

(List continued on next page.)

FOREIGN PATENT DOCUMENTS

| | | | |
|---|---|---|---|
| 945037 | 12/1963 | United Kingdom | 15/49 R |

OTHER PUBLICATIONS

*Now the Seal-Rite Applicator* brochure, Seal-Rite Applicator, Inc. (date unknown).

(List continued on next page.)

*Primary Examiner*—Kenneth J. Dorner
*Attorney, Agent, or Firm*—David A. Burge

[57] ABSTRACT

An apparatus for dispensing, mixing and applying coating constituents to traffic surfaces has a wheeled transport carriage that supports a reservoir for coating constituents that are to be dispensed. A dispensing system regulates the dispensing of coating constituents from the reservoir onto traffic surface portions that extend centrally beneath the carriage. A power drive system moves the carriage across selected portions of traffic surfaces, rotates a set of mixing and applicator tools that extend in a radial array beneath the carriage, and rotates a set of blending blades within the reservoir to maintain coating constituent homogeneity, with these functions characteristically being carried out concurrently during the dispensing of coating constituents from the reservoir. The power drive system includes a carriage-mounted source of rotary energy such as an engine, and provides for coordinated operation of the power driven components at appropriate relative speeds of rotation to facilitate the application of coating constituents to traffic surfaces in a desired manner and with desired uniformity. Method aspects of the invention reside in the coordinated manner in which separate sets of power driven components are operated to enhance the character and uniformity of coatings that are applied to traffic surfaces.

24 Claims, 4 Drawing Sheets

U.S. PATENT DOCUMENTS

| | | | |
|---|---|---|---|
| 2,717,725 | 9/1955 | Bennett | 222/485 |
| 2,725,945 | 12/1955 | Beaudoux et al. | 180/6.24 |
| 2,754,733 | 7/1956 | Beyer | 94/45 |
| 2,779,965 | 2/1957 | Schilberg | 16/26 |
| 2,796,202 | 6/1957 | Lawrence et al. | 222/233 |
| 2,796,208 | 7/1957 | Masters et al. | 222/311 |
| 2,799,037 | 7/1957 | Grogan | 15/172 |
| 2,835,420 | 5/1958 | Foley | 222/485 |
| 2,962,946 | 12/1960 | Neff | 94/44 |
| 3,130,653 | 4/1964 | Talbott | 94/45 |
| 3,153,992 | 10/1964 | Dabelle | 94/44 |
| 3,183,803 | 5/1965 | Gierhart | 94/44 |
| 3,187,845 | 6/1965 | Ashley, Jr. et al. | 188/16 |
| 3,206,174 | 9/1965 | Young | 259/149 |
| 3,221,619 | 12/1965 | Erickson | 94/50 |
| 3,241,976 | 3/1966 | Rank et al. | 94/44 |
| 3,245,329 | 4/1966 | Nagin et al. | 94/22 |
| 3,279,337 | 10/1966 | Weaver | 94/44 |
| 3,283,675 | 11/1966 | Gifford et al. | 94/39 |
| 3,305,887 | 2/1967 | Turner | 15/50 |
| 3,333,518 | 8/1967 | Sholl et al. | 94/44 |
| 3,452,381 | 7/1969 | Bratti | 15/98 |
| 3,458,885 | 8/1969 | Danielsson | 15/50 |
| 3,515,041 | 6/1970 | Murtaugh | 94/44 |
| 3,533,336 | 10/1970 | Wikel | 94/44 |
| 3,550,866 | 12/1970 | Swenson | 239/677 |
| 3,559,543 | 2/1971 | Schwoebel, Jr. | 94/44 |
| 3,580,638 | 5/1971 | Pullen | 299/25 |
| 3,683,761 | 8/1972 | Babic | 94/45 |
| 3,703,856 | 11/1972 | Wikel et al. | 94/44 |
| 3,771,893 | 11/1973 | Miller | 404/101 |
| 3,776,430 | 12/1973 | Grandrud | 222/177 |
| 3,791,754 | 2/1974 | Zochil | 404/112 |
| 3,807,634 | 4/1974 | Vogt | 239/150 |
| 3,841,779 | 10/1974 | Ray | 404/111 |
| 3,936,212 | 2/1976 | Holz, Sr. et al. | 404/112 |
| 3,989,403 | 11/1976 | Verive | 404/111 |
| 4,074,385 | 2/1978 | Howard et al. | 15/180 |
| 4,096,879 | 6/1978 | Serur et al. | 137/391 |
| 4,172,580 | 10/1979 | Raftis et al. | 251/8 |
| 4,302,127 | 11/1981 | Hodson | 404/102 |
| 4,302,128 | 11/1981 | Thatcher | 404/111 |
| 4,315,700 | 2/1982 | Heiligtag et al. | 404/111 |
| 4,318,631 | 3/1982 | Vickers | 404/93 |
| 4,350,293 | 9/1982 | Lestradet | 239/155 |
| 4,357,953 | 11/1982 | Patterson | 137/88 |
| 4,365,377 | 12/1982 | Todd et al. | 15/98 |
| 4,477,203 | 10/1984 | Laditka | 404/111 |
| 4,603,999 | 8/1986 | Laditka | 404/112 |
| 4,958,955 | 9/1990 | Laditka | 404/75 |
| 5,085,537 | 2/1992 | Laditka | 404/75 |

OTHER PUBLICATIONS

An untitled brochure published by Erie-Go Manufacturing Co. (date unknown).

*Applicator for Emulsified Asphalt & Tar Seal Cost Materials,* Pavers Mfg. Co. (date unknown).

*Specialized Sealcoating Equipment for Quality Jobs,* Contract Asphalt Maintenance Co. (date unknown).

*Seal-Master, Asphalt Maintenance Equipment* by Wikel (date unknown).

*Seal-Mor,* Neal Mfg. Co., Inc. (date unknown).

*Seal Master Blacktop Sealing Machine* brochure, Wikel Mfg. Co. (date unknown).

*Huber SC-150 Sealcoat Applicator* brochure, Huber Corp. (date unknown).

*Nu-Surf Seal Applicator* brochure, Gierhart Machinery Co. (date unknown).

*Asphalt Sealing Machine* brochure, Allied Steel & Tractor Products, Inc. (date unknown).

*The New Surf-Seal for Asphalt Sealcoating* brochure, Specialized Equipment of Wakeman (date unknown).

*Seal-Master Applicator* brochure, Winkel Mfg. Co. (date unknown).

*Now the Erie Applicator* brochure, Erie Applicator, Inc. (date unknown).

METHODS AND APPARATUS FOR DISPENSING, MIXING AND APPLYING COATING CONSTITUENTS TO TRAFFIC SURFACES, AND TRAFFIC SURFACES COATED USING SUCH METHODS

CROSS-REFERENCE TO RELATED PATENTS AND APPLICATIONS

The present application is a continuation-in-part of U.S. application Ser. No. 07/586,909 filed Sep. 24, 1990 (issued Feb. 4, 1992 as U.S. Pat. No. 5,085,537—referred to hereinafter as the fourth Parent Case), which was filed as continuation-in-part of U.S. application Ser. No. 07/368,084 filed Jun. 19, 1989 (issued Sep. 25, 1990 as U.S. Pat. No. 4,958,955—referred to hereinafter as the Third Parent Case), which was filed as a continuation of U.S. application Ser. No. 07/213,449 filed Jun. 28, 1988, which was filed as continuation of U.S. application Ser. No. 07/085,253 filed Aug. 11, 1987 (abandoned), which was filed as a continuation of U.S. application Ser. No. 06/892,337 filed Aug. 1, 1986 (abandoned), which was filed as a continuation-in-part of U.S. application Ser. No. 06/532,742 filed Sep. 16, 1983 (issued Aug, 5, 1986 as U.S. Pat. No. 4,603,999—referred to hereinafter as the Second Parent Case), which was, in turn, filed as a continuation-in-part of U.S. patent application Ser. No. 06/408,484 filed Aug. 16, 1982 (issued Oct. 16, 1984 as U.S. Pat. No. 4,477,203—referred to hereinafter as the First Parent Case), the disclosures of all of the aforementioned being incorporated herein by reference.

The invention disclosed and claimed herein is the work product of a continuing development effort that resulted in the inventions of the First, Second, Third and Fourth Parent Cases (referred to collectively hereinafter as the Parent Cases), and that provides a number of improvement features that can be used separately from or in conjunction with features of the inventions of one or more of the Parent Cases.

BACKGROUND OF THE INVENTION

1. Field of the Invention

The present invention relates to methods and apparatus for dispensing, mixing and applying coating constituents to form desired types of coatings on relatively large surface areas that characteristically are referred to as "traffic surfaces," typically roadway surfaces such as highways, streets, driveways, parking lots, runways, taxiways, and tarmacs and the like; and, the invention relates to traffic surfaces that are coated by utilization of the methods hereof. One aspect of the present invention relates to a coordinated manner in which power-driven components are utilized in concert with a regulated dispensing of coating constituents to facilitate the application of traffic surface coatings that are characterized by consistently good uniformity.

2. Prior Art

In the present document, the term "traffic surface" is used in a generic sense to refer to a wide class of substantially horizontal surfaces such as highways, streets, driveways, parking lots, runways, taxiways, tarmacs, floors of large garages and industrial buildings, loading dock decks, and the like that need to be coated from time to time to protect, restore and enhance surface integrity.

Because traffic surfaces are exposed to wear and often to the effects of the elements, they are subject to deterioration and periodically require the application of coatings to protect, restore and enhance their integrity, and to thereby extend their useful lives. Some traffic surfaces should be coated when constructed, as by the application of a coating that seals exposed surfaces and thereby protects against water penetration that, in winter, can cause spalding or cracking. Many traffic surfaces require protective and reconditioning coating periodically and/or after the surfaces have been subjected to a certain amount of use.

While the prior art presents many proposals that seek to address needs that are encountered in applying coating constituents to traffic surfaces, a need nonetheless remains for a power operated apparatus that advantageously and efficiently combines a transport carriage, a carriage mounted reservoir for containing coating constituents that are to be dispensed, a center-fed system for regulating the dispensing of coating constituents from the reservoir onto traffic surface portions that are located centrally beneath the carriage, and a carriage mounted power drive system for selectively providing rotary energy to carriage-connected components that include a power driven set of wheels for moving the carriage across a traffic surface, a power driven blending system for maintaining coating constituent homogeneity within the reservoir, and a power driven set of rotary tools that extend in a radial array beneath the carriage for mixing, spreading and applying dispensed coating constituents with consistently good uniformity onto traffic surface portions that are engaged by the rotary tools as the carriage is moved across a traffic surface.

The Referenced Parent Cases

The referenced First Parent Case, U.S. Pat. No. 4,477,203, discloses an apparatus for dispensing plural coating constituents from separate reservoirs that are supported atop a wheeled carriage, with an power-driven array of rotary tools being provided to mix, spread and apply the coating constituents after they have been dispensed. The referenced Second Parent Case, U.S. Pat. No. 4,603,999, discloses an apparatus that utilizes a roller or wheel supported carriage to position an array of power driven rotary tools to effect "finishing" of coating constituents applied to a traffic surface. The referenced Third Parent Case, U.S. Pat. No. 4,958,955, discloses an apparatus that utilizes a plurality of arrays of power-driven rotary tools to mix, spread and apply dispensed coating constituents to traffic surfaces. The referenced Fourth Parent Case, U.S. Pat. No. 5,085,537, discloses an apparatus that utilizes a hollow shaft to centrally support an array of power-driven rotary tools, and that utilizes a center-fed system for dispensing coating constituents through the hollow shaft. Methods that utilize various features of these inventions also are disclosed by the referenced Parent Cases.

Not specifically addressed by the inventions of the referenced Parent Cases is the need that remains for a power operated system that advantageously and efficiently combines a transport carriage, a carriage mounted reservoir for containing coating constituents that are to be dispensed, a center-fed system for regulating the dispensing of coating constituents from the reservoir onto traffic surface portions that are located centrally beneath the carriage, and a carriage mounted power drive system for selectively providing rotary energy to carriage connected components that include a power driven set of wheels for moving the carriage across a traffic surface, a power driven blending system for maintaining coating constituent homogeneity within the reservoir, and a power driven set of rotary tools that extend in a radial array beneath the carriage for mixing, spreading and applying dispensed coating constituents with consistently good uniformity onto traffic surface portions that are engaged by the rotary tools as the carriage is moved across the traffic surface.

While the system of the present invention may, in some modes of practice, make use of a number of features that are disclosed in one or more of the referenced Parent Cases, the system of the present invention provides an improved combination of features that extends beyond the scope of the referenced Parent Cases.

SUMMARY OF THE INVENTION

The present invention addresses the foregoing and other drawbacks of the prior art by providing a novel and improved methods and apparatus for dispensing, mixing and applying coating constituents to traffic surfaces; and by providing resulting surface coatings that are desirably characterized by consistently good uniformity. A feature of the preferred practice of the present invention resides in the use that is made of power driven apparatus to mix, spread and apply dispensed coating constituents in an operationally-coordinated manner that facilitates and enhances the capability of the apparatus to apply a variety of desired types of traffic surface coatings with consistently good uniformity.

An apparatus that embodies the best mode known to the inventor for carrying out the practice of this invention is illustrated in the drawings hereof, and is capable, concurrently, 1) of maintaining homogeneity of reservoir-carried coating constituents prior to their being dispensed, 2) of dispensing, mixing, spreading and applying coating constituents on smooth and/or irregular traffic surfaces ranging in size from relatively small to relatively large, 3) of mixing, spreading and applying dispensed coating constituents as by utilizing at least one set of rotary tools that are rotated about a substantially vertically extending center axis, 4) of dispensing coating constituents from the reservoir in a regulated, "center fed" manner as by ducting the coating constituents downwardly through a hollow shaft that centrally mounts the rotary tools, so that the coating constituents are discharged onto the traffic surface at a central location amidst the set of rotary tools for being engaged by the tools as the apparatus moves across the traffic surface, and 5) of coordinating these concurrent functions so that desired types of coating applications are provided that are characterized by consistently high uniformity.

In accordance with the preferred practice of the present invention, a system for applying a coating to a traffic surface utilizes a power driven unit that dispenses coating constituents in a regulated manner onto traffic surface portions that extend along a forward path of travel of the power driven unit. The unit preferably includes a wheel supported transport carriage that extends substantially horizontally. At least one set of rotary tools is rotatably supported beneath the carriage for mixing, spreading and applying dispensed coating constituents. The set of tools rotates relative to the carriage about a center axis that extends substantially vertically. A hollow, tubular stub shaft extends along the center axis, depends from the carriage, and is circumferentially engaged by bearings that connect the set of tools to the carriage for rotation about the center axis. As the unit moves forwardly along the travel path, at least one regulated flow of fluid coating constituents (i.e., a regulated flow of a fluid portion of such coating constituents as are to be dispensed onto portions of the traffic surface that underlies the carriage) is ducted along the center axis through the hollow stub shaft for discharge substantially centrally relative to the associated set of rotating tools. As the carriage moves along its forward path of travel, the set of rotating tools is brought into engagement with deposited constituents, thereby causing the tools mix the constituents in situ, and to spread and apply the resulting mixture of constituents to coat the traffic surface. By coordinating such features as the forward velocity of the carriage and the rotational speed of the set of rotary tools, the uniformity of the resulting coating is enhanced and rendered more consistent.

In preferred practice, at least one fluid reservoir is provided atop the transport carriage for containing at least one fluid coating constituent. A rotatable shaft carrying a plurality of blending blades extends through the fluid reservoir and is power driven to assist in maintaining the homogeneity of fluid constituent. An adjustable control regulates the dispensing of the fluid constituent from the fluid reservoir, and the regulated flow is "center-fed" through the hollow tubular shaft for discharge at a location that is "central" to an associated set of rotating tools that mixes, spreads and applies the dispensed coating constituents. By coordinating the rate of rotation of the blending blades with other factors such as the rate of rotation of the tools and the forward velocity of the power driven unit, the uniformity of the resulting coating further enhanced.

In preferred practice, a trailing finishing blade depends from rearward portions of the carriage to effect final smoothing of the applied coating, and to minimize wheel marks in the resulting coating. The finishing blade is adjustably connected to the carriage so that it can be adjusted vertically as may be needed to accommodate wear and to assure that the blade is positioned properly with respect to the traffic surface during operation of the apparatus.

While the preferred embodiment of the invention that is depicted in the drawings and that is described later herein includes only one set of rotary tools and defines only one center axis about which a set of rotary tools rotates to effect mixing, spreading and application of coating constituents, it will be understood by those who are skilled in the art that a plurality of rotary tool units, each rotating about a separate, substantially vertically extending center axis, can be utilized to advantage, for example in such "tandem" arrangements as are described and illustrated in the referenced Third Parent Case. In one form of practice, the "tandem" rotary tool units are arranged side-by-side so that, as the apparatus is moved forwardly along a path of travel, each of the side-by-side rotary tool units treats a separate portion of the width of a "treatment zone" or "travel path" that is traversed by the apparatus. In another form of practice, at least some of the rotary tool units are arranged relatively forwardly and rearwardly with respect to each other so that as the apparatus is moved forwardly along its travel path, the forward and rearward rotary tool units are brought sequentially into contact with portions of the treatment zone.

In still another form of practice, the forward rotary tool units can (through the use of their hollow stub shafts to duct coating constituents onto the traffic surface being coated) serve to effect a first center-fed dispensing and mixing in situ of selected coating constituents; and, the rearward tool units can (through the use of their hollow stub shafts to duct coating constituents onto the traffic surface being coated) serve to effect a second dispensing and mixing in situ of other selected coating constituents—whereby selected coating constituents can be deposited onto and at least partially mixed, spreadand/or applied to a traffic surface before other selected coating constituents are deposited, mixed, spread and applied. Inasmuch as staged or separate deposits of coating ingredients often represent desirable approaches to use in effecting desired types of coating applications (e.g., in conjunction with applications of liquids that are to be mixed with particulates, or in conjunction with applications of constituents that harden or cure when mixed to form epoxy coatings, etc.), the use of staged center-fed sets of rotary tools represents a good example of how features that are disclosed in the referenced Parent Cases can be combined with features of the present invention to provide desired types of system performance.

Other advantages that can obtain through the use of features of the inventions of the referenced Parent Cases reside in the provision of finishing apparatus that is capable of effecting uniform, in situ mixing of coating ingredients that range in consistency from very thin, slurry-like liquids to very viscous tar-like gels and/or particulates. Where very viscous ingredients are being used, often it is desirable to utilize arrays of alternating mixing and spreading tools. By way of example (and as is described in detail in the referenced Parent Cases), rake-like mixing tools may be used to break up and mix particulate coating ingredients with viscous slurry coatings so that blade-like spreading tools can effect application of coating materials with a desired degree of uniformity.

BRIEF DESCRIPTION OF THE DRAWINGS

The foregoing and other features of the invention will be better understood by referring to the description of the preferred embodiment and the claims which follow, taken together with the accompanying drawings, wherein:

DESCRIPTION OF THE PREFERRED EMBODIMENT

Figure 1:
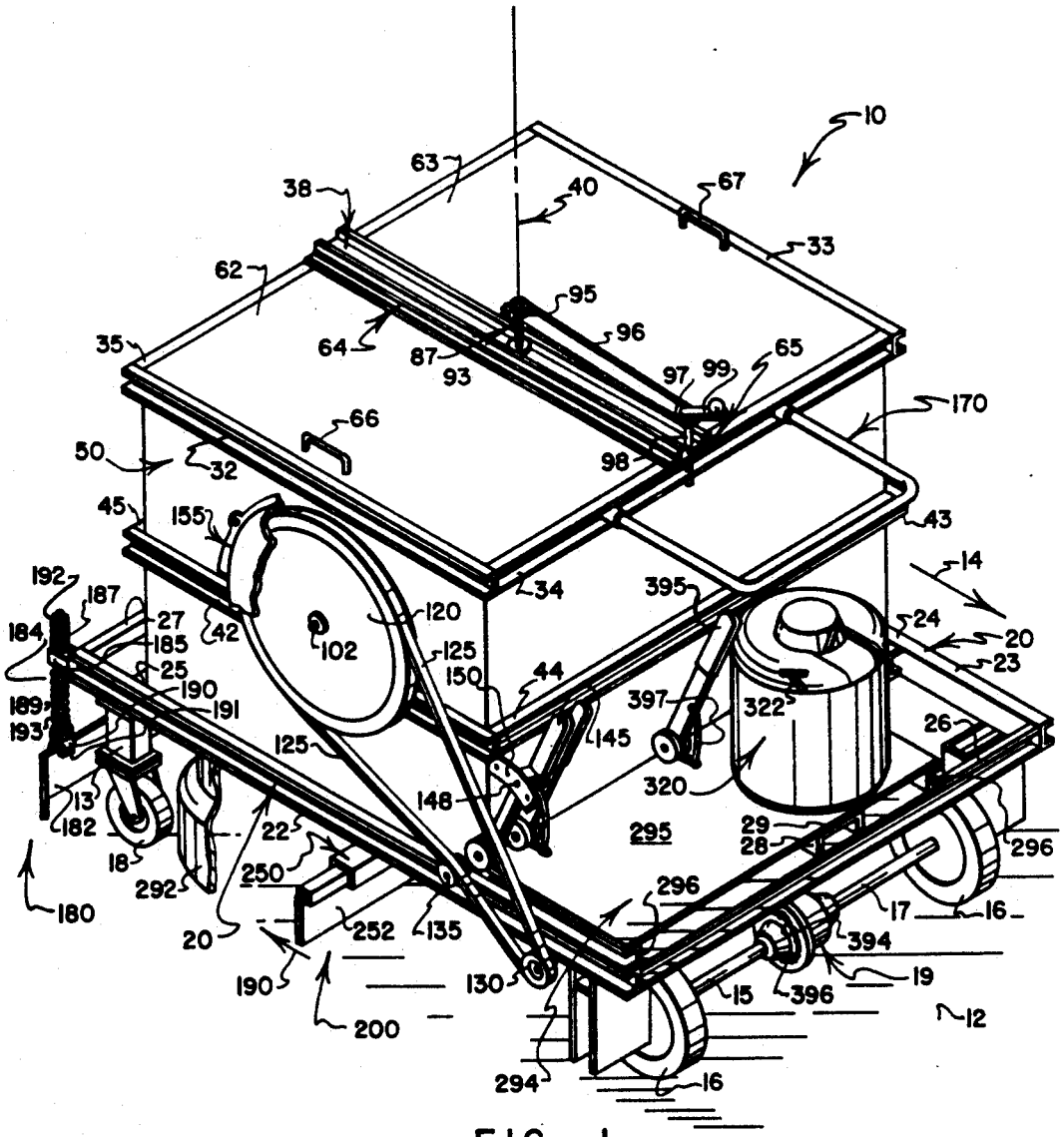
FIG. 1 is a perspective view of a surface finishing apparatus that embodies the preferred practice of the present invention, with the apparatus employing a set of rotary tools to mix, spread and apply coating constituents to traffic surface portions that underlie a wheel-supported transport carriage, with the view showing principally top, front and right side portions thereof, and with portions of two protective enclosures removed to permit certain hidden features to be seen.
Figure 2:
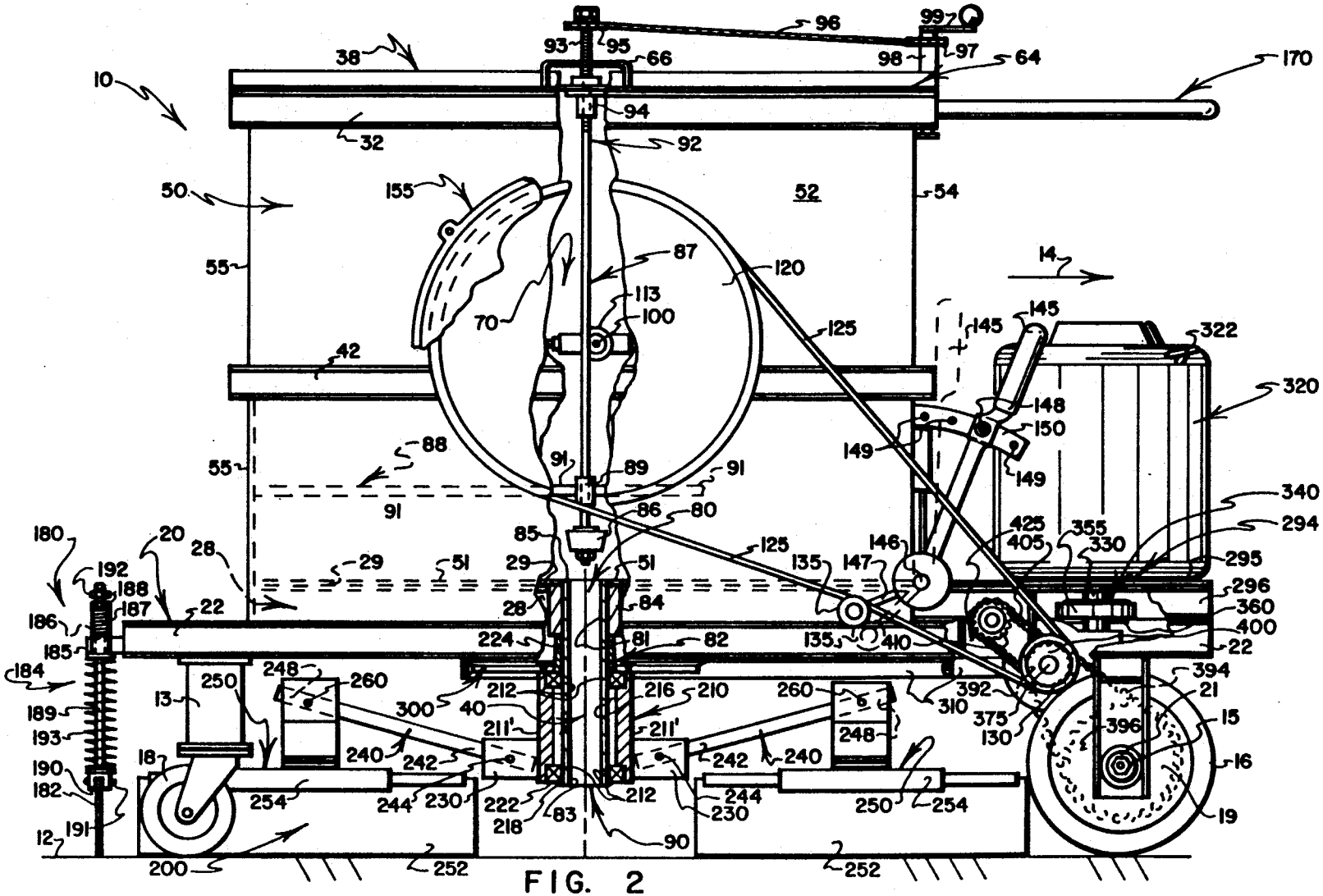
FIG. 2 is a right side elevational view thereof with portions broken away to permit certain otherwise hidden features to be seen, and with a few hidden features depicted by broken lines.
Figure 3:
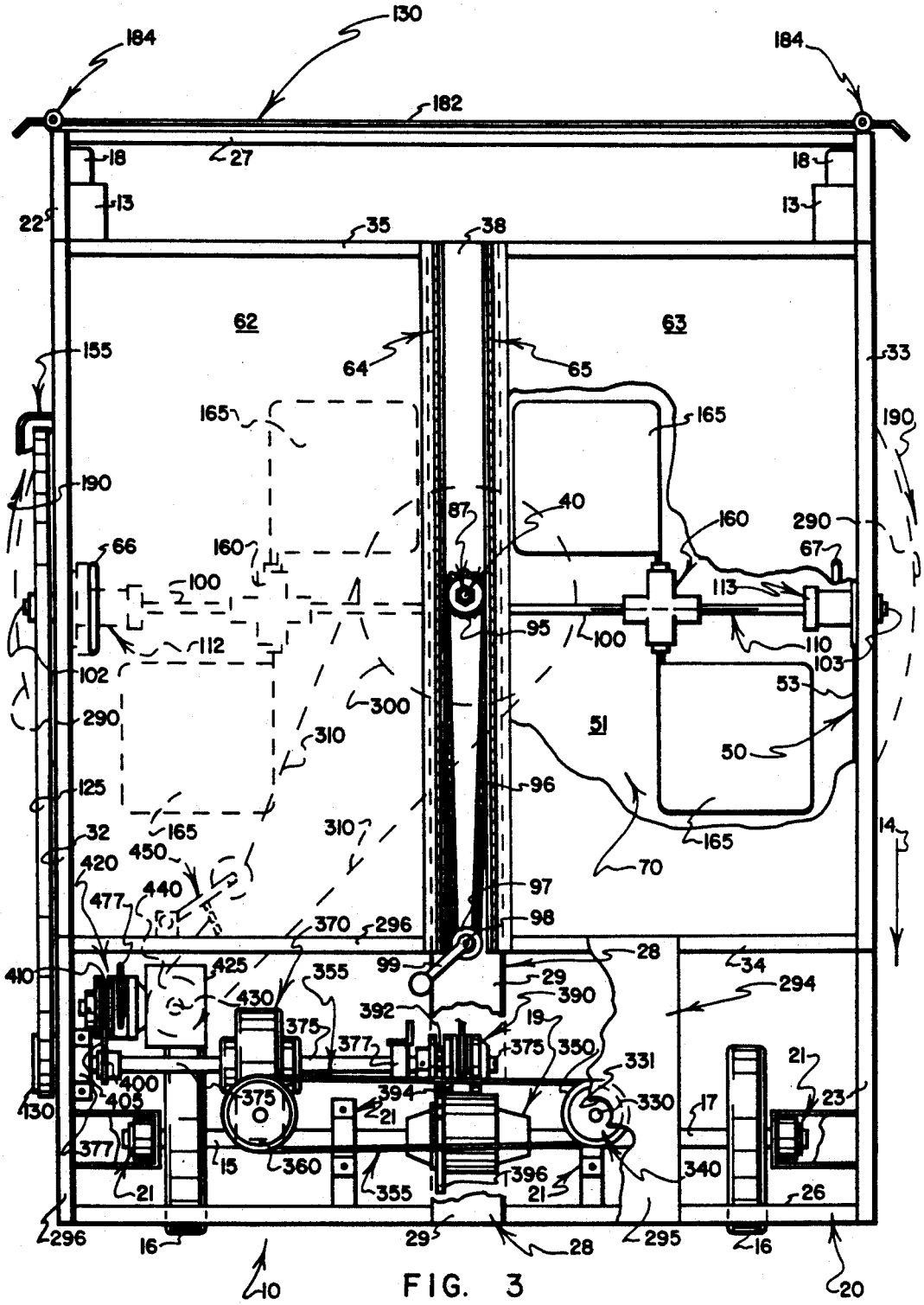
FIG. 3 top plan view thereof with portions broken away to permit certain otherwise hidden features to be seen, and with a few hidden features depicted by broken lines; and, FIG. 4 is a front elevational view thereof with portions broken away to permit certain otherwise hidden features to be seen, and with a few hidden features depicted by broken lines.
Figure 4:
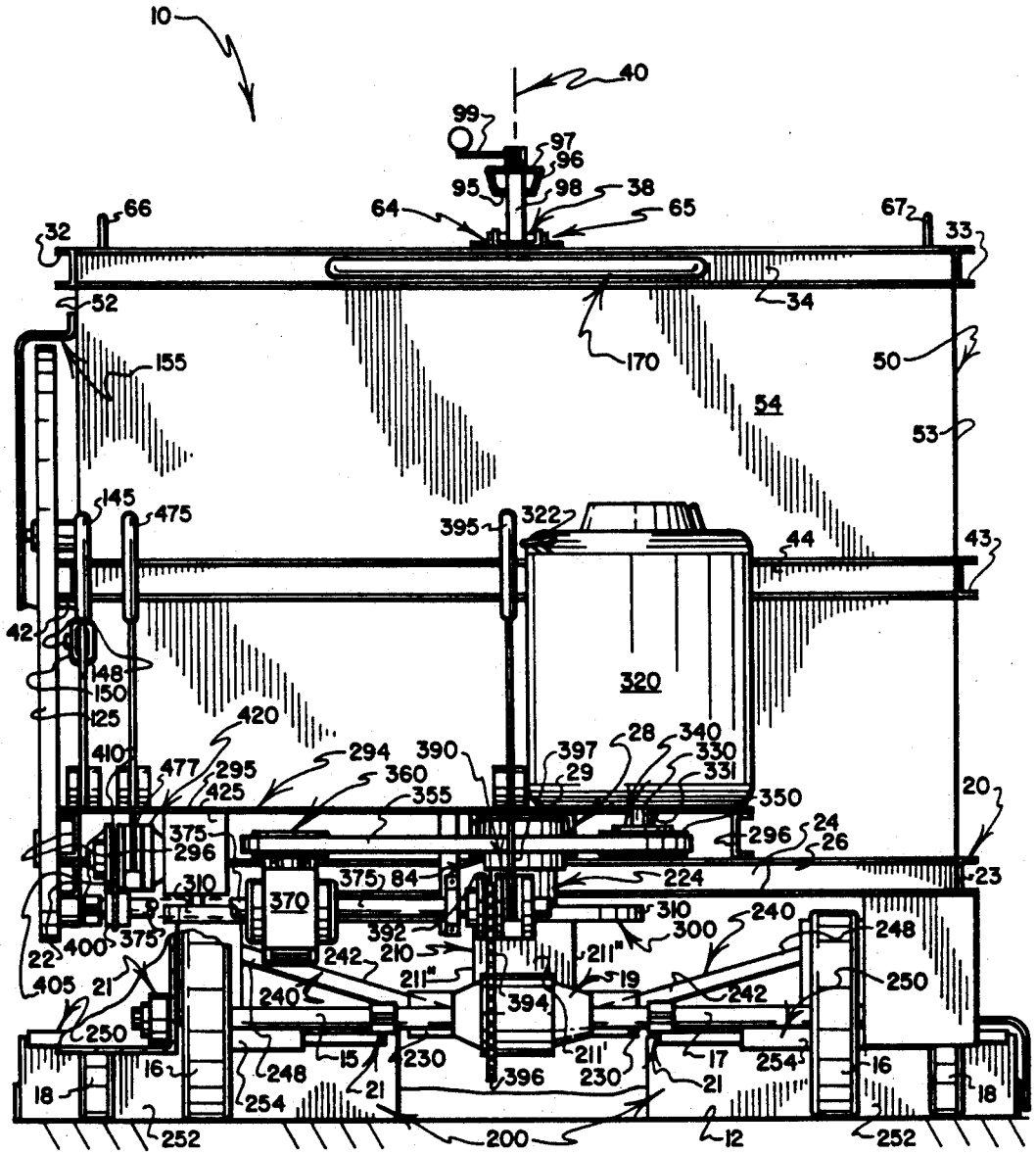

Referring to FIGS. 1–4, a preferred form of apparatus or machine for dispensing, mixing, spreading and applying coating constituents to traffic surfaces is indicated generally by the numeral 10. In FIGS. 1, 2 and 4, the machine 10 is shown positioned atop a traffic surface 12. A forward direction of movement of the machine 10 across the traffic surface is indicated in FIGS. 1–3 by the arrow 14.

The machine 10 includes forward and rearward wheels 16, 18, respectively, that underlie and support a carriage structure 20 atop the traffic surface 12. As is best seen in FIG. 3, the forward wheels 16 are mounted on coaxially extending right and left axles 15, 17 that project from opposite sides of a commercially purchased differential unit 19. Carriage-mounted bearings 21 journal the axles 15, 17 for rotation. As is best seen in FIG. 2, the rearward wheels 18 are commercially purchased swivel wheel assemblies that are connected to post-like formations 13 that depend from rear corner regions of the carriage structure 20. The swivel character of the rearward wheels 18 permits the carriage 20 to be "steered" or "guided" as it is moved across the traffic surface 12. While the forward wheels 16 do not swivel, they are power driven through the axles 15, 17 to facilitate moving the machine 10 across the traffic surface 12, as will be discussed in greater detail.

The wheels 16, 18 support the carriage structure 20 so that it extends substantially parallel to the plane of such portions of the traffic surface 12 as underlie and are engaged by the wheels 16, 18. When the traffic surface portions that underlie and support the wheels 16, 18 extend in a substantially horizontal plane, the carriage structure 20 likewise extends substantially horizontally.

An imaginary "center axis" of the machine 10 is depicted in FIGS. 1, 2 and 4 by a centerline, indicated by an arrow 40. In FIG. 3, the machine's center axis is depicted by a dot, indicated by an arrow 40. The center axis 40 extends substantially normal to (i.e., substantially perpendicular to) the plane of the traffic surface 12. When the plane of the traffic surface 12 is horizontal (i.e., as it is depicted in FIGS. 1, 2 and 4), the center axis 40 extends substantially vertically. However, if the plane of the traffic surface that is supporting the machine 10 does not extend horizontally, it will be understood by those who are skilled in the art that the center axis 40 will be correspondingly inclined from the vertical. Thus, while for purposes of simplification in many portions of this document, the center axis 40 is referred to by such terms as "extending vertically," it will be understood that the center axis 40 actually extends precisely vertically only when such portions of the traffic surface 12 as are engaged by the wheels 16, 18 extend precisely in a common horizontal plane. Likewise, it will be understood that the use herein of such terms as "extending vertically," "extending horizontally" and the like is for purposes of simplifying the description and is not intended to limit the scope of coverage.

The carriage structure 20 includes a welded assembly of lengths of structural steel that have substantially identical channel-shaped cross sections, including right and left side members 22, 23 (FIGS. 1–4)that extend along lower portions of upstanding right and left sidewalls 52, 53 an of a generally rectangular tank assembly 50; front and rear transversely extending members 24, 25 (FIG. 1) that extend along lower portions of upstanding front and rear sidewalls 54, 55 of the tank assembly 50; and, front and rear end members 26, 27 (FIGS. 1 and 3) that extend between opposed front and rear end regions, respectively, of the right and left side members 22, 23.

The carriage members 22–27 are arranged such that their upper surfaces all extend in one horizontally extending plane; such that their lower surfaces all extend in another horizontally extending plane; and such that the transversely extending members 24–27 each have one of their ends welded to the upstanding web of the right side member 22, while their other ends are welded to the upstanding web of the left side member 23. By this arrangement, the members 22–27 cooperate to form a simple but rigid, generally rectangular framework; and the members 22–24 extend perimetrically about the upstanding sidewalls 52–54 of the tank 50.

The carriage 20 also includes a bottom beam 28 (FIGS. 1 and 3) that extends forwardly-rearwardly at a location that is substantially centered between the right and left sides of the carriage 20. The bottom beam 28 overlies and is welded to central portions of the top surfaces of each of the transversely extending members 24, 25 and 26. While the carriage members 22–27 preferably all are formed from structural steel that has a common channel-shaped cross-section (preferably a cross-section having a center web that measures about two inches in height), the bottom beam 28 preferably is formed from a significantly heavier piece of structural steel that has a flange height (as viewed in FIG. 1) of about two inches and a central web width (as viewed in FIG. 1) that measures about six inches. By welding the distal edges of the flanges of the bottom beam 28 to the top surfaces of the transversely extending members 24, 25 and 26 at locations that are mid-way along the lengths of the members 24, 25 and 26, the central web of the bottom beam 28 is oriented to define a flat, upwardly facing surface 29 (FIGS. 2–4) that is used to support portions of a bottom wall 51 (FIG. 2) of the tank 50.

Referring variously to FIGS. 1–4, the tank 50 is a welded assembly of steel side walls 52–55 and a steel bottom wall 51, with each of the walls 51–55 being of substantially rectangular configuration. The tank 50 is reinforced near its lower end 1) by the aforedescribed channel members 22–25 which extend perimetrically about the bottom of the tank 5, and 2) by the bottom beam 28 that underlies portions of the bottom wall 51 of the tank 50.

In the manner that the channel members 22–25 provide a generally rectangular frame that perimetrically surrounds and reinforces lower portions of the sidewalls 52–55 of the tank 50, a similar set of channel members 32–35 is provided to define a generally rectangular frame that perimetrically surrounds and reinforces upper portions of the tank sidewalls 52–55. And, in a similar manner, a set of channel members 42–45 (that is identical to the set of channel members 32–35) is provided to form a generally rectangular frame that perimetrically surrounds middle portions of the sidewalls 52–54 of the tank 50. In preferred practice, each of the channel members 22–27, 32–35 and 42–45 is formed from structural steel that has a common channel-shaped cross section.

Referring to FIGS. 1 and 3, in the same manner that the bottom beam 28 1) underlies (and is welded to) the bottom wall 51 of the tank 50 and 2) extends across (and is welded to) top surfaces of the channel members 24–26, a top beam 38 is provided that 1) overlies the tank 50 and 2) extends across (and is welded to) top surfaces of the channel members 34 and 35.

Right and left door panels 62, 63 are pivotally connected to the top beam 38 by "continuous hinge" assemblies 64, 65 that extend along (and are welded to) opposite upstanding flanges of the top beam 38. Right and left handles 66, 67 are provided to facilitate pivoting the door panels 62, 63 between the closed positions that are depicted in the drawings and open positions (not shown) that permit fluid coating constituents to be poured into the reservoir 70 that is defined by the tank 50.

While the tank assembly 50 is described and depicted herein as defining only a single reservoir chamber 70 (FIG. 3) for receiving fluid coating constituents (not shown) that are to be dispensed onto the traffic surface 12, it is possible for the tank assembly 50 to be constructed so as to provide a plurality of compartments or reservoirs (not shown—but discussed in a number of the referenced Parent Patents, e.g., in the referenced Fourth Parent Case) for containing and dispensing segregated quantities of coating constituents.

Referring to FIG. 2, a centrally located outlet opening 80 is defined in the bottom of the tank 50. The outlet opening 80 is defined by an upper end region 81 of a tubular stub shaft member 82 that projects through a centrally located hole 85 that is formed in the bottom wall 51. The tubular stub shaft member 82 extends coaxially about the center axis 40 and has a lower end region 83 that is located several inches below the bottom wall 51 of the tank 50. A discharge opening 90 is defined by the lower end region 83 of the tubular stub shaft member 82.

Surrounding the upper end region 81 of the tubular stub shaft member 82 is a relatively thick reinforcing sleeve 84. The sleeve 84 has its upper end extending into underlying engagement with the bottom surface of the bottom wall 51 of the tank 50 to securely support the bottom wall 51 in the vicinity of the outlet opening 80. The sleeve 83 is welded to the upper end region 81 of the tubular stub shaft member 82, to the bottom wall 51 of the tank 50, and to the bottom beam 28, and thereby reinforces the junctures of these components within the vicinity of the outlet opening 80.

Referring still to FIG. 2, a tapered, stopper-like valve member 86 is provided for controlling the flow of coating constituents from the reservoir 70 through the outlet opening 80 and through the tubular stub shaft member 82 for downward discharge onto the traffic surface 12 through the discharge opening 90. A control rod 87 carries the valve member 86 and extends upwardly through the tank 50 along the center axis 40. Spaced above the outlet opening 80 is a guide-like support member 88 that assists in keeping the control rod 87 aligned along the center axis 40. The support member 88 includes a sleeve 89 through which portions of the control rod 87 loosely extend, and elongate body portions 91 that rigidly connect with the front and rear walls 54, 55 of the tank 50.

The control rod 87 has an upper end region 92 that carries a coarse set of threads 93. Welded to the top beam 38 is a threaded sleeve 94 through which the upper end region 92 of the control rod 87 is threaded. Welded to the upper end of the control rod 87 is a toothed sprocket 95 (FIGS. 1–3) which, when rotated in clockwise and counterclockwise directions about the center axis 40 serves to thread the control rod 87 through the threaded sleeve 94 to raise and lower the valve member 86 relative to the outlet opening 80. When in its lowermost position (not shown), the valve member 86 sealingly engages such upper end region portions of the tubular stub shaft 82 as define the outlet opening 80—much in the same manner that a tapered sink stopper wedgingly closes the upwardly facing drain opening of a sink. The extent to which the valve member 86 is raised above the outlet opening 80 serves to regulate the rate at which fluid coating constituents discharge from the reservoir 70 through the outlet opening 80 and thence through the discharge opening 90 onto portions of the traffic surface 12 that underlie the machine 10.

To control the position of the valve member 86 relative to the outlet opening 80, a roller chain 96 is reeved around the sprocket 95 and around a second sprocket 97 that is supported on a stub shaft 98 that is connected to the front end region of the top beam 38. An operator control in the form of a crank handle 99 is connected to the second sprocket 97 for rotation therewith about the axis of the stub shaft 98. By rotating the crank handle 99 selectively clockwise and counterclockwise, the chain interconnected sprockets 95, 97 cause the control rod 87 to selectively raise and lower the valve member 86 between positions that permit a desirably regulated flow of fluid coating constituents to discharge through the discharge opening 90, and a position wherein the valve member 86 closes the outlet opening 80 to stop the discharge of fluid coating constituents from the discharge opening 90.

Referring to FIGS. 2 and 3, a blender shaft 100 extends substantially centrally through the tank 50 from side to side thereof. Right and left end regions 102, 103 of the blender shaft 100 extend through aligned holes that are formed centrally through the right and left side walls 52, 53 and through the right and left frame members 42, 43, respectively. Right and left lubricated bearing units 112, 113 are connected to the right and left side walls 52, 53 and extend for short distances into the reservoir 70 that is defined by the tank 50. The bearing units 112, 113 journal the left and right end regions 102, 103 of the blender shaft 100 and cooperate with the shaft 100 to define an axis of blender shaft rotation that is indicated in FIG. 3 by the arrow 110.

Referring to FIGS. 1 and 2, a relatively large diameter V-belt pulley 120 is connected to the right end region 102 of the blender shaft 100 for rotating the blender shaft 100 preferably at a rate of rotation that is between about 30 to about 60 revolutions per minute. A V-belt 125 is reeved around the relatively large pulley 120 and around a relatively small pulley 130 that is located relatively near the right front corner of the carriage 20. A belt tensioner pulley 135 engages the periphery of the belt 125 for purposes of loosening and tightening the grip of the belt 125 on the pulleys 120, 130 so as to selectively establish a driving connection therebetween.

Referring to FIG. 2, a position of the tensioner pulley 135 that tensions the belt 125 adequately to establish a driving connection between the pulleys 120, 130 is shown in solid lines, while a position of the tensioner pulley 135 that releases belt tension adequately to provide no driving connection between the pulleys 120, 130 is shown in dotted lines, with corresponding positions of a control lever 145 that positions the tensioner pulley 135 also being shown in solid and in dotted lines. The control lever 145 is pivotally connected to a stub shaft 146 that is welded to the front wall 54 of the tank 50, and has an arm 147 that projects from the vicinity of the stub shaft 146 to support the tensioner pulley 135. A spring detent 148 carried by the lever 145 is engageable with a series of holes 149 formed in a curved bracket 150 that projects forwardly from the front wall 54 of the tank 50 to releasably retain the control lever 145 in its belt-tensioning position (shown in solid lines in FIG. 2) and its non-tensioning position (shown in dotted lines in FIG. 2). In preferred practice, a safety enclosure type of guard loosely surrounds the belt 125 and the pulleys 120, 130, 135 to prevent persons and objects from inadvertently coming into engagement with these drive connection components. Portions of such a guard-type enclosure are indicated by the numeral 155 in each of FIGS. 1–4.

Referring to FIG. 3, two hubs 160 are mounted on the blender shaft 100 at spaced locations within the tank 50. Blender blades 165 are carried by the hubs 160. Rigid driving connections are established by the hubs 160 between the blender shaft 100 and the blender blades 165 so that, when the blender shaft 100 is rotated about its axis 110, the blender blades 165 are caused to rotate within the tank 50 to cause stirring, mixing and blending of such fluid constituent coating components as are contained within the reservoir 70 that is defined by the tank 50.

Referring to FIGS. 1, 2 and 4, a generally U-shaped handle 170 extends forwardly from the channel member 34 that extends along top portions of the front wall 54 of the tank 50. In preferred practice, the handle 170 is formed as a welded assembly from three pieces of structural steel or steel pipe. The purpose of the handle 170 is to provide a strong, easy-to-grasp structure that will enable an operator to physically guide the movement of the machine 10.

Referring to FIGS. 1–3, a trailing type of resilient finishing blade assembly 180 is mounted at the rear of the carriage 20 for depending toward and into gentle engagement with such traffic surface portions as have been coated during passage thereover of other operational components of the machine 10. A purpose served by the resilient finishing blade assembly 180 is to assist in assuring that a newly applied coating is smooth and uniform—and to minimize the possibility that wheel tracks are left in the newly applied coating.

The resilient finishing blade assembly 180 is adjustably connected to the carriage 20 by means of right and left mounting assemblies 184 that are identical except for the fact that one connects with the rear end of the left carriage channel 22 while the other connects with the rear end of the right carriage channel 22. Since the mounting assemblies 184 are identical, only one will be described.

Referring to FIG. 2 wherein features of one of the mounting assemblies 184 is best depicted, a support bracket 185 has an internally threaded, substantially vertically extending hole 186 formed therethrough. An externally threaded tubular adjustment sleeve 187 is threaded into the hole 186 and has a hex formation 188 near its upper end for permitting a wrench (not shown) to be utilized to thread the sleeve 187 upwardly or downwardly through the hole 186 as may be desired to selectively adjust the vertical position of the tubular sleeve 187. A support rod 189 extends vertically through the tubular sleeve 187. A yoke formation 190 is defined at the lower end of the support rod 189 for receiving an upper edge portion of the resilient member 182. A fastener 191 extends through aligned holes that are formed through the yoke formation 190 and through upper edge portions of the resilient member 182 to securely connect the support rod 189 to the resilient member 182. The upper end of the support rod 189 is threaded carries at least one lock nut 192 thereon. A compression coil spring 193 is interposed between the lower end of the tubular sleeve 187 and the yoke formation 190 to bias the resilient member 182 downwardly toward engagement with the traffic surface 12.

The mounting assemblies 184 are adjustable both to vertically position the resilient member 182 and to set a permitted range of travel through which the resilient member 182 can move vertically. By treading the sleeve 187 upwardly or downwardly relative to its associated support bracket 185, and by selectively positioning the lock nut 192 on the support rod 189, these adjustments are effected. In preferred practice, the bottom edge of the resilient member 182 preferably is positioned to gently engage the traffic surface 12, and a small but reasonable range of vertical travel is set through which the resilient member 182 is permitted to move to accommodate variations that may be encountered in the traffic surface 12.

Disposed beneath the carriage assembly 20 and extending in a radially arranged array relative to the center axis 40 is a set of rotary finishing tools 200 that is power driven to rotate about the center axis 40 to mix, spread and apply coating constituents that are deposited on the traffic surface 12. Referring principally to FIG. 2 (but also with occasional reference to FIG. 4), the rotary tool unit 200 includes a rotary member 210 that is rotatably connected by bearings 212 to the hollow, depending stub shaft 82 through which at least a fluid portion of such coating constituents as are to be applied to the traffic surface 12 are dispensed. The rotary member 210 is a four-sided block of steel that defines four upstanding outer faces 211 that are arranged in opposed pairs, with the faces of each pair extending parallel to each other, and with the faces of the two pairs extending substantially perpendicular to each other. Faces of one of the pairs are designated by the numeral 211' in FIG. 2. Faces of the other pair are designated by the numeral 211" in FIG. 4.

Referring to FIG. 2, internal features of the rotary member 210 include a centrally-extending passage through 216 that extends along the center axis 40. The passage 216 is enlarged near its upper and lower end regions to receive the bearings 212. A snap ring 218 engages a circumferentially extending groove that is formed toward the bottom end region of the stub shaft 82 to hold a washer 222 in place above the snap ring 218. The washer 222 engages the bottom bearing 212 and assists in retaining the rotary member 210 in place on the stub shaft 82. A sleeve-like spacer 224 is provided atop the upper bearing 212 and extends into engagement with the bottom of the reinforcing sleeve 84 that forms a part of the welded assemblage of the carriage structure 20 and tank assembly 50, described above.

A pulley 300 is bolted to the upper end region of the rotary member 210 and, when driven by means of a belt 310 that is reeved around the pulley 300, serves to rotate the rotary member 210 about the center axis 40 preferably within the range of about 40 to about 70 rpm.

The four-sided block of steel that forms the rotary member 210 carries four identical yoke-like formations 230 (two of which are shown in FIG. 2, with the remaining two being shown only partially in FIG. 4). The yoke-like formations 230 extend radially outwardly relative to the center axis 40, with each of the formations 230 extending substantially perpendicular to its two nearest neighbor formations 230. Inner end regions 242 of four tubular arms 240 (two of which are shown in FIG. 2, with the remaining two being shown in FIG. 4) are received within the yoke-like formations 230, and are pivotally connected thereto by pivot pins 244 (two of which are shown in FIG. 2) that extend substantially horizontally through aligned holes formed in the yoke formations 230 and in the inner end regions 242 of their associated tubular arms 240.

Four blade-like applicator tools 250 (two of which are depicted in FIG. 2, with the remaining two being depicted in FIG. 4) are positioned beneath outer end regions 248 of the tubular arms 240. The applicator tools 250 can take any of a variety of forms, but preferably take the forms that are described in detail in the referenced Parent Patents, whereby many of the tools 250 each has a resilient, blade-like bottom portion 252 that extends upwardly and connects with a rigid support 254 that is pivotally connected to a separate one of outer end regions 248 of the arms 240. In preferred practice, yoke like structures 256 are defined by the supports 254 to extend along opposed sides of the outer end regions 248, and pivot pins 260 (two of which are shown in FIG. 2) extend through aligned holes that are formed through the outer end regions 248 and through the yoke-like structures 256 to pivotally connect the applicator tools 250 to the radially extending arms 240.

While the arms 240 extend substantially radially with respect to the center axis 40, the blade-like applicator tools 250 preferably are canted or inclined relative to the arms 240 so that outer end regions of the blades 250 tend to lead inner end regions when the rotary tool unit 200 is rotated about the axis 40 in a forward direction of rotation which is indicated in FIGS. 1 and 3 by arrows 190. Moreover, the pivot pins 260 that pivotally connect the blade-like applicator tools 250 to the tubular arms 240 preferably are inclined slightly relative to the horizontal, typically by only about five degrees, so that upper portions of the blade-like applicator tools 250 tend to slightly lead lower portions of the tools 250 when the rotary tool unit 200 is rotated in the direction of the arrows 190. These slight inclinations or incantations of the applicator tools assist in minimizing tool "chatter" and "drag," help to maintain proper control of such coating constituents as are being mixed, spread and applied to the traffic surface 12, and tend to assist in assuring that coating constituents are mixed properly and are applied smoothly.

As can be seen in FIGS. 1 and 4, outer end regions 251 of the blade-like applicator tools 250 extend beyond the width the carriage 20 (it being understood that the "width of the carriage 20" is defined by the distance between the outermost surfaces of the side channels 22, 23) as they rotate about the center axis 40 (e.g., in FIG. 3, curved, dotted lines designated by the numeral 290 depict the rotary path of the outer end regions 251 of the blade-like applicator tools 250). To provide for operator safety, arcuate, skirt-like guards preferably are provided to protectively enclose the outer end regions 251 to the extent that they project beyond the width of the carriage 20 during rotation about the center axis 40. In FIG. 1, a portion of one such skirt-like guard is indicated generally by the numeral 292.

The forward end portion of the carriage 20 is provided with an elevated motor-mount platform that is indicated in each of FIGS. 1–4 by the numeral 294. The platform 294 includes a flat metal plate 295 of generally rectangular configuration that is rigidly secured (typically by welding) to the upper face 29 of the bottom beam 28, and to various lengths of channel members 296 that are rigidly secured (typically by welding) atop portions of one or more of the carriage channels 22, 24, 26.

Located beneath the flat metal plate 295 are a number of drive components that cooperate to distribute rotary energy that is supplied by a depending output shaft 330 of an engine 320 (or other source of rotary energy such as an electrically powered motor, not shown). The engine 320 typically is about a 3½ horsepower internal combustion engine that has an output shaft speed of up to about 3600 revolutions per minute, and is rigidly secured to the flat metal plate 295 (typically by means of removable fasteners, not shown) such that its output shaft 330 depends substantially vertically through a hole 331 (FIG. 4) that is formed through the plate 295.

So that the engine 320 can be started in a "no load" condition, and so that the operation of the engine 320 can be smoothly and successfully brought up to a reasonable operating speed before any load is applied to the output shaft 330, a centrifugal clutch 340 (see FIG. 3) is connected to the output shaft 330. The centrifugal clutch 340 is a commercially purchased assembly that has its mechanism housed in a generally cylindrical enclosure bordered circumferentially by a V-belt pulley 350 that is drivingly connected to the output shaft 330 of the engine 320 only when the rotation of the output shaft 330 has been brought up to a reasonable speed, typically about 2200 revolutions per minute.

Continuing to refer principally to FIG. 3, a V-belt 355 is reeved around the pulley 350 of the centrifugal clutch 340 and around a pulley 360 that inputs rotary energy to a right angle speed reducer 370. A jackshaft 375 extends through the hollow output connection (not shown) of the speed reducer 370. A pair of bearings 377 journal the jackshaft 375 at locations spaced from the speed reducer 370 and on opposite sides thereof. The bearings 377 are connected by suitable mounting brackets (not shown) to components of the welded carriage structure 20.

Near the left end region of the jackshaft 375 (i.e., the right end region as viewed in FIGS. 3 and 4), a mechanically engageable/disengageable clutch 390 is provided for selectively drivingly connecting the jackshaft 375 to a clutch-carried sprocket 392. A roller chain 394 is reeved around the sprocket 392 and around the input sprocket 396 of the differential 19. The differential 19 functions to transmit rotary energy to the front axles 15, 17 and thence to the front wheels 16 to move the machine 10 along a preselected path of travel at a forward velocity that preferably is within the range of about 1.5 to about 3.0 miles per hour. Referring to FIGS. 1 and 4, a control lever 395 is connected by suitable linkage 397 to the mechanical clutch 390 to permit the clutch 390 to be selectively engaged and disengaged to selectively transmit rotary energy from the engine-driven jackshaft 375 to the front wheels 16.

The right end region of the jackshaft 375 (i.e., the left end region as viewed in FIGS. 3 and 4) is drivingly connected to the V-belt pulley 130 that drives the belt 125. The belt 125 selectively rotates the blender shaft 100, depending on whether the lever 145 is positioned to tension or to release tension in the belt 130, as has been described.

Near the right end region of the jackshaft 375 (i.e., near the left end region as viewed in FIGS. 3 and 4), a sprocket 400 is drivingly connected to the jackshaft 375. A roller chain 405 is reeved around the sprocket 400 and around a sprocket 410 that forms a part of a mechanically operated clutch 420. As is best seen in FIG. 3, the clutch 420 is positioned beside and is drivingly connected to input rotary energy to a right angle gearbox 425. The gearbox 425 has a vertically extending output shaft 430 that is drivingly connected to a V-belt pulley 440. The V-belt 310 (that previously has been described as being reeved around the pulley 300 that rotates the set of rotary tools 200 about the center axis 40) also is reeved about the pulley 440 and is constantly held taut by means of a spring-biased idler assembly 450. The idler assembly 450 is connected to the carriage 20 at a location beneath the tank 50 and serves to constantly maintain proper tension in the belt 310 to enable the pulley 440 to drive the pulley 300. A control lever 475 is provided with suitable linkage 477 for connecting with and operating the clutch 420 to selectively drivingly connect the engine-driven jackshaft 375 with the gearbox 425 for selectively rotating the rotary tools 200.

Referring to FIGS. 1, 2 and 4, the engine 320 is provided with a throttle lever 322 to enable the speed of its output shaft 330 to be adjusted. In preferred practice, the normal operating range of the engine is preferably held within a range of about 2200 to about 3600 revolutions per minute. With the engine 320 operating within the range of about 2200 to about 3600 rpm, the drive linkage that connects with the front axles 15, 17, with the blender shaft 100, and with the V-belt pulley 300 that rotates the rotary tools 200 preferably is designed to serve the functions 1) of moving the machine 10 along a forward path of travel at a forward velocity of between about 1.7 to about 2.7 miles per hour, 2) of rotating the blender blades 165 at between about 34 and about 53 revolutions per minute, and 3) of rotating the set of tools 200 at between about 42 and about 66 revolutions per minute.

At an engine speed just slightly higher than 2200 rpm, the drive wheels 16 begin to move the machine 10 at about 1.7 mph; and, assuming that the two mechanical clutches 390, 420 are engaged, the set of rotary tools 200 begins rotating at about 42.5 rpm while the blender shaft 100 begins rotating at about 34 rpm. At a more "normal" engine speed of about 2700–2800 rpm, the forward velocity of the machine 10 is preferably within the range of about 2.1 to about 2.2 mph; the rotary tools 200 turn at about 52 to about 53 rpm;, and, the blender shaft 100 rotates at about 42–43 rpm. At a maximum engine speed of about 3300 to about 3400 rpm, the forward velocity of the machine 10 is preferably within the range of about 2.6 to about 2.7 mph; the tool rotation speed is preferably within the range of about 65–66 rpm; and the blender shaft rotation speed is preferably within the range of about 52–53 rpm.

By coordinating the forward velocity of the machine 10 with the speed of rotation of the tools 200, and by simultaneously maintaining a regulated rate of discharge of fluid coating constituents that, taken together, will result in the fluid coating constituents being applied such that about a gallon covers about 45 to about 55 square feet, consistently good uniformity of the applied coating should result. Likewise, by suitably coordinating the speed of rotation of the blender blades 165 with the speed of rotation of the tools 200 and with the forward velocity of the machine 10, achieving a uniform discharge rate of homogeneously mixed fluid constituents from the reservoir 70 is facilitated.

In preferred practice, maintaining the forward velocity of the machine within the range of about 1.7 to about 2.7 miles per hour while maintaining the speed of rotation of the rotary tools 200 within the range of about 42 to about 66 revolutions per minute while also maintaining a substantially constant ration of about 1 to 25 between the velocity in miles per hour of the machine 10 and the rotational speed in revolutions per minute of the rotary tools 200 will help to maintain uniformity of application of the resulting coating. Furthermore, by maintaining the rotational speed in revolutions per minute of the blender blades 165 between about 34 to about 53, while assuring that the rate of discharge of fluid coating constituents provides for the spreading of a gallon of fluid coating constituents over about 45 to about 55 square feet of traffic surface will likewise help to maintain uniformity of application of the resulting coating.

As will be apparent from the foregoing description, features of the present invention reside in the utilization of a multi-functional power drive system to operate selected components of a traffic surface coating unit so that important parameters that contribute to the uniformity of the resulting coating are held within desired predetermined limits and preferably are suitably coordinated to facilitate the application of coating in a manner that is characterized by consistently good uniformity.

Although the invention has been described in its preferred form with a certain degree of particularity, it is understood that the present disclosure of the preferred form has been made only by way of example and that numerous changes in the details of construction may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A method of applying a substantially uniform coating composition to contiguous selected portions of a traffic surface by using a power-driven apparatus, wherein the method comprises the following steps that are performed substantially concurrently, including:

a) depositing a plurality of coating composition ingredients upon selected portions of a traffic surface to be coated;

b) moving at least one set of rotary tools along a forward path of travel at a controlled forward velocity to bring the set of rotary tools into contact with deposited coating composition ingredients, with the set of rotary tools including an associated rotary structure having 1) a plurality of associated depending blades that are arranged in an array about an associated center axis that extends substantially normal to the selected portions of the traffic surface, and 2) having connection means movably connecting at least selected ones of the associated blades to the associated rotary structure so that, when the set of rotary tools is rotated about the associated center axis, at least said selected ones of the associated blades are permitted to move a limited amount relative to the associated rotary structure to accommodate the character of said selected portions of the traffic surface to maintain relatively close, substantially parallel contact with such selected portions of the traffic surface as are engaged by the associated blades;

c) rotating the set of rotary tools about its associated center axis at a controlled rate of tool rotation with at least said selected associated blades being urged into substantially continuous contact with said selected portions of the traffic surface and into contact with coating composition ingredients deposited thereon to effect a relatively rapid mixng of the deposited ingredients to achieve a condition of substantially uniform coating consistency;

d) applying to said selected traffic surface portions a coating of substantially uniform consistency that results from said mixing of said deposited ingredients, with the application being effected by continuing to rotate the set of rotary tools about its associated center axis at said controlled rate of tool rotation, with at least said selected associated blades moving relative to their associated rotary structure as is needed to conform to the contour of and to substantially maintain contact with said selected traffic surface portions; and, e) with the aforedescribed steps that are performed substantially concurrently including the steps of:

i) mixing within a fluid reservoir at least a fluid portion of the coating composition ingredients that are to be deposited onto the selected traffic surface portions, with said mixing within a fluid reservoir being effected at least in part by operating blender means within a fluid reservoir that is located atop the rotating set of rotary tools, and with the operation of the blender means serving to assist in maintaining the homogeneity of the fluid portion of the coating composition ingredients carried within the reservoir;

ii) ducting a regulated flow of said substantially homogenous fluid mixture of ingredients from the reservoir to and through a discharge station so as to deposit the flow of ingredients onto selected traffic surface portions that underlie the discharge station, with the discharge station being located substantially centrally with respect to the rotating, depending blades of said set of rotary tools; and, iii) moving the center axis of said set of rotary tools along said forward path of travel and at said controlled forward velocity, with said movement along said forward path of travel and at said controlled forward velocity serving "in concert" with said "regulated" dispensing and flow of coating ingredients, and serving "in concert" with said controlled rate of rotation of said set of rotary tools to effect the application of a substantially uniform coating to the contiguous surface area of said selected traffic surface portions.

2. A traffic surface coated substantially uniformly in accordance with the method of claim 1.

3. The method of claim 1 wherein 1 additionally including the steps of:

a) providing wheeled transport carriage means for supporting such structure as defines said reservoir, for supporting said blender means, for supporting the rotary tools for rotation about the associated center axis at a rotary tools rate of rotation, and for supporting the power-driven apparatus atop a traffic surface for movement along the forward path of movement at said controlled forward velocity;

b) providing power drive means including a source of rotary energy and connection means 1) for drivingly connecting with the blender means to operate the blender means, 2) for drivingly connecting with at least selected ones of the wheels of the transport carriage for driving the selected wheels to move the carriage along the forward path of movement at said controlled forward velocity, and 3) for drivingly connecting with the rotary tools for rotating the rotary tools at said controlled rate of tool rotation; and, c) operating the power drive means to operate the blender means, to drive the selected wheels to move the carriage along the forward path of movement at said controlled forward velocity, and to drive the rotary tools at said controlled rate of rotation.

4. A traffic surface coated substantially uniformly in accordance with the method of claim 3.

5. The method of claim 3 wherein the step of operating the power drive means includes moving the carriage along the forward path of movement at a controlled forward velocity within the range of about 1.7 to about 2.7 miles per hour.

6. A traffic surface coated substantially uniformly in accordance with the method of claim 5.

7. The method of claim 5 wherein the step of operating the power drive means includes rotating the set of rotary tools at a controlled rate of tool rotation within the range of about 42 to about 66 revolutions per minute.

8. A traffic surface coated substantially uniformly in accordance with the method of claim 7.

9. The method of claim 7 wherein the step of operating the power drive means includes maintaining a substantially constant ratio of about 1 to 25 between the velocity in miles per hour at which the transport carriage is moved along the forward path of travel, and the rotational speed in revolutions per minute at which the rotary tools are driven at said controlled rate of tool rotation whereby, for example, when the forward velocity of the transport carriage is about 1.7 miles per hour, the controlled rate of tool rotation is about 42.5 revolutions per minute.

10. A traffic surface coated substantially uniformly in accordance with the method of claim 9.

11. The method of claim 1 wherein the step of operating the blender means includes the step of rotating a plurality of blending blades that are disposed within the fluid reservoir, that are drivingly connected to and supported by a blender shaft that extends through selected portions of the reservoir, and that are rotatable in unison with the blender shaft when the blender shaft is rotated about a blender shaft axis along which the blender shaft extends substantially coaxially, with the rotation of the blender blades being effected by rotating the blender shaft about the blender axis, and with the rotation of the blender blades serving to stir, mix and blend the fluid mixture that is contained in the reservoir to assist in maintaining its homogeneity.

12. A traffic surface coated substantially uniformly in accordance with the method of claim 11.

13. The method of claim 11 wherein the step of rotating a plurality of blending blades includes the step of operating the power drive means to rotate the blender shaft about the blender shaft axis at a speed of rotation that is within the range of about 34 to about 53 revolutions per minute.

14. A traffic surface coated substantially uniformly in accordance with the method of claim 13.

15. Apparatus for applying to a traffic surface a coating composition consisting of plural ingredients, the apparatus comprising:

a) carriage means including a frame and wheels for supporting the frame atop a traffic surface to be coated, and having an imaginary center axis that extends substantially normal to such portions of the traffic surface as extend along a path of travel and underlie the carriage means as the carriage means moves across traffic surface portions while moving along the travel path;

b) supply source means including at least one container that is connected to the carriage means as by being mounted on the frame for containing fluid coating constituents that are to be applied to the traffic surface, with said container having a bottom wall that intercepts the center axis, and having bottom wall portions that define an outlet opening that extends about the center axis, and with the supply source having power-driven blender means for extending into such fluid coating constituents as are carried within said container to mix and blend such constituents to facilitate maintaining the homogeneity thereof;

c) dispensing means connected to the frame and including:

i) a hollow tubular member that communicates with said outlet opening and depends along the center axis from the location of said outlet opening for defining a discharge opening that is spaced below the outlet opening, with the discharge opening being spaced above traffic surface portions that underlie the carriage;

ii) valve means for selectively permitting and regulating the flow of coating constituents from said container through said discharge opening, including a valve member that is configured to seatingly engage the outlet opening that is provided in the bottom wall of said container for selectively blocking the flow of coating constituents from said container through the outlet opening, and for selectively permitting a regulated flow of coating constituents from said container through the outlet opening; and, iii) valve control means for positioning the valve member relative to the outlet opening so as to selectively move the valve member between a position blocking the flow of coating constituents from said container through the outlet opening, and a position that opens said outlet opening sufficiently to provide a regulated flow of coating constituents through the outlet opening;

d) applicator means for mixing the deposited ingredients in situ on the traffic surface, and for spreading and applying the resulting coating composition to the traffic surface, including at least one set of rotary tools, with said set including:

i) an associated rotary structure that extends about and is movably connected to said hollow tubular member for being rotated about the center axis;

ii) a plurality of associated depending blades that are arranged in an array about the center axis;

iii) connection means for movably interconnecting at least selected ones of the associated blades to the associated rotary structure for permitting limited movements of the selected associated blades relative to the associated rotary structure so as to accommodate the character of such portions of the traffic surface as pass beneath said selected associated blades and to maintain relatively close, substantially parallel contact with such portions of the traffic surface as the carriage means moves along the path of travel;

e) power drive means connected to the carriage means as by being supported on the frame, and including:
   i) engine means for rotating a drive shaft;
   ii) centrifugal clutch means drivingly connected to the drive shaft, having output means, and being operable to drivingly connect the drive shaft with the output means for concurrent rotation when the engine is rotating the drive shaft at or above a predetermined speed of rotation;
   iii) first drive connection means drivingly connected to the output means for transferring rotary drive motion from the output means to at least selected ones of the wheels that support the frame for effecting self-propelled movement of the carriage means along the travel path across the traffic surface; and,
   iv) second drive connection means drivingly connected to the output means for transferring rotary drive motion from the output means to the rotary structure for rotating the associated depending blades about the center axis as the carriage means moves along the travel path to effect mixing, spreading and application of the dispensed coating constituents to coat the traffic surface.

16. The apparatus of claim 15 wherein the power drive means also includes third drive connection means connected to the blender means for transferring rotary drive motion from the output means of the rotary structure for operating the blender means.

17. A rotary tool apparatus for depositing coating constituents on a traffic surface, for forming a coating composition on a traffic surface by mixing and spreading the deposited constituents, and for applying the resulting coating composition to the traffic surface as by smoothly spreading the same thereover irrespective of the lateral dimensions of the traffic surface, comprising:

a) wheel-supported frame means having at least one substantially vertically extending center axis, with the frame means including a frame structure and a plurality of wheels for supporting the frame structure atop a traffic surface;

b) power drive means connected to and supported by the frame means for providing a source of rotary motion;

c) hollow, tubular stub shaft means rigidly connected to and supported by the frame means, including at least one hollow, tubular structure that extends about a separate one of said at least one center axis, and having a lower end region that depends from the frame means along its associated center axis to for defining an associated discharge opening that is spaced above traffic surface portions that underlie the carriage;

d) reservoir means connected to and supported by the frame means and defining interior region means for receiving and containing one or more quantities of coating constituents, including at least one tank-like structure having a bottom wall portion means that cooperates to define at least a part of said interior region means, with the bottom wall portion means having outlet opening means formed therethrough including at least one separate outlet opening that is associated with each of the separate tank-like structures, with said least one outlet opening being positioned within relatively close proximity to at least one associated center axis;

e) dispensing means for ducting one or more controlled flows of coating constituents from said outlet opening means into the associated hollow, tubular stub shaft means that extends along said associated center axis, and for discharging such ducted controlled flows through said associated discharge opening onto traffic surface that underlie said associated hollow, tubular stub shaft means, including:
   i) conduct means for communicating said at least one part of said interior regions means with the interior of said associated hollow, tubular stub shaft means for ducting at least one flow of coating constituents from said outlet opening means into said associated hollow, tubular stub shaft means for discharge through said associated discharge opening;
   ii) valve means including a separate valve member associated with each of said outlet openings for selectively permitting and preventing said at least one flow of coating constituents to discharge from said reservoir means through said associated outlet opening and into said conduct means, with each of the separate valve members being configured to be moved into and out of seated, sealing engagement with such structure as surrounds and defines its associated outlet opening; and,
   iii) valve control means for positioning each of said valve members relative to its associated outlet opening so as to selectively move such valve member between a position of seated, sealing engagement with such structure as surrounds the associated outlet opening, and positions spaced from the associated outlet opening that selectively permit an associated controlled flow of coating constituents through the associated discharge opening into portions of the associated conduit means and through portions of the associated hollow stub shaft means for discharge through the associated discharge opening onto underlying portions of the traffic surface;

f) applicator means for mixing the deposited constituents in situ on the traffic surface, and for spreading and applying the resulting coating composition to the traffic surface, including at least one set of rotary tools, with each such set including:
   i) an associated rotary structure that extends about and is movably connected to a selected one of said hollow, tubular stub shafts for being rotated about the associated center axis;
   ii) an associated blade set including a plurality of associated depending blades that are arranged in an array about the associated center axis;
   iii) connection means for movably interconnecting at least selected ones of the associated blades to the associated rotary structure for permitting limited movements of the selected associated blades relative to the associated rotary structure so as to accommodate the character of such portions of the traffic surface as pass beneath said selected associated blades during rotation of the associated blades about the associated center axis, and to maintain relatively close, substantially parallel contact with such portions of the traffic surface as the carriage means moves along the path of travel; and, g) drive connection means connected to and supported by the frame means for transferring rotary energy from said power drive means to at least one of said sets of rotary tools for rotating such set of tools about its associated center axis as said carriage means is caused to travel across selected portions the traffic surface that reside along a path of travel, with the dispensing means being operated during such travel to deposit coating constituents onto said selected portions of the traffic surface, and with the rotation of said rotary tool means by said power drive means serving to mix and spread the deposited coating constituents, and to apply the resulting coating to said selected portions of the traffic surface.

18. The rotary tool apparatus of claim 17 additionally including power operated blended means extending into the interior region means for engaging coating constituents carried therein to mix said constituents and to thereby facilitate the maintenance of constituent homogeneity within the interior region so that, when said contents are dispensed therefrom, the character of the contents that is dispensed tends to be of relatively uniform homogeneity.

19. The rotary tool apparatus of claim 18, wherein the power drive means includes engine means for providing a power driven drive shaft that serves as a source of rotary motion, throttle means connected to the engine means for controlling the speed of rotation of the drive shaft, clutch means including 1) input means drivingly connected to the drive shaft for rotation in response to rotation of the drive shaft, 2) output means drivingly connected to said rotary tool means for supplying rotary energy thereto for rotating said rotary tool means about said at least one associated center axis, and 3) drive coupling means for selectively drivingly interconnecting the input means with the output means for selectively transmitting rotary energy therebetween to rotate the output means in response to rotation of the input means.

20. The rotary tool apparatus of claim 19, wherein said clutch means includes a centrifugal clutch that has an input that defines said input means, an output that defines said output means, and means for defining said drive coupling means for selectively drivingly connect the input means with the output means for concurrent rotation only when the engine is rotating the drive shaft at or above a predetermined speed of rotation.

21. The rotary tool apparatus of claim 20 wherein said drive coupling means is operative to drivingly connect the input means with the output means when the speed of rotation of the drive shaft is substantially equal to or greater than 2200 rpm.

22. The rotary tool apparatus of claim 19 additionally including propulsion drive connection means for drivingly connecting the drive shaft of the engine means to at least selected ones of the wheels that support the frame structure for effecting self-propelled movement of the frame means across the traffic surface along the path of travel.

23. The rotary tool apparatus of claim 22 wherein said propulsion drive connection means is operative to effect self-propelled movement of the frame means across the traffic surface at a speed within the range of about 1.7 to about 2.7 mph in response to operation of the engine means to rotate the drive shaft within the range of about 2200 rpm to about 3600 rpm.

24. The rotary tool apparatus of claim 17 wherein the drive connection means is operative to rotate said at least one of said sets of rotary tools at a rotational speed between about 42 and about 66 revolutions per minute when the apparatus is being moved along a forward path of travel to dispense, mix, spread and apply coating constituents, and wherein the velocity of movement along said path of travel is within the range of about 1.7 to about 2.7 miles per hour.

* * * * *